United States Patent [19]

Uytterhoeven et al.

[11] Patent Number: 4,606,989

[45] Date of Patent: Aug. 19, 1986

[54] LIQUID DEVELOPER FOR DEVELOPMENT OF ELECTROSTATIC IMAGES

[75] Inventors: Herman J. Uytterhoeven, Bonheiden; August M. Mariën, Oevel; Walter F. De Winter, 's-Gravenwezel, all of Belgium

[73] Assignee: Agfa-Gevaert N.V., Mortsel, Belgium

[21] Appl. No.: 776,860

[22] Filed: Sep. 18, 1985

[30] Foreign Application Priority Data

Oct. 2, 1984 [EP] European Pat. Off. ..... 84201397.1

[51] Int. Cl.[4] ..... G03G 9/12

[52] U.S. Cl. ..... 430/106; 430/115

[58] Field of Search ..... 430/106, 115

[56] References Cited

U.S. PATENT DOCUMENTS

| | | | |
|---|---|---|---|
| 4,243,736 | 1/1981 | Herrmann | 430/115 |
| 4,415,646 | 11/1983 | Gruber et al. | 430/115 X |
| 4,525,446 | 6/1985 | Uytterhoeven et al. | 430/115 X |
| 4,547,449 | 10/1985 | Alexandrovich et al. | 430/115 |

*Primary Examiner*—Roland E. Martin

*Attorney, Agent, or Firm*—William J. Daniel

[57] ABSTRACT

A liquid developer composition that is suitable for rendering visible electrostatically charged areas which composition contains in an electrically insulating non-polar carrier liquid having a volume resistivity of at least $10^9$ ohm.cm and a dielectric constant less than 3, dispersed coloring matter acting as toner particles and at least one anionic polymer that includes recurring units incorporating an anionic group together with a non-polymeric counter cation, characterized in that the cation is a selected from the group consisting of:

(1) a cationic group which is a protonated tertiary amine group, (2) a quaternary ammonium group, a phosphonium group or a sulphonium group, and (3) a cationic group containing at least one carbon chain residue comprising at least 6 carbon atoms, whereby the anionic polymer is adsorbed with a net negative charge on the toner particles.

8 Claims, No Drawings

LIQUID DEVELOPER FOR DEVELOPMENT OF ELECTROSTATIC IMAGES

The present invention relates to a liquid developer for development of electrostatic images.

Known electrophotographic processes comprise the steps of electrostatically charging in the dark a photoconductive surface, image-wise exposing said surface whereby the irradiated areas become discharged in accordance with the intensity of radiation thus forming a latent electrostatic image, and developing the material to form a visible image by depositing on the image a finely divided electroscopic material known as "toner". The toner particles consist of or include colouring substances e.g. carbon black. The thus developed image may be fixed to the surface carrying the electrostatic charge image or transferred to another surface and fixed thereon.

A process of developing an electrostatic image by use of an electrically insulating liquid developer, which contains dispersed particles of colouring substance called toner particles, that render the charge pattern visible through the phenomenon of electrophoresis, has been described already e.g. in the U.S. Pat. No. 2,907,674 of Kenneth Archibald Metcalfe and Robert John Wright issued Oct. 6, 1959.

In electrophoretic development a distinction is made between developers having dispersed toner particles which possess a positive charge and those which possess a negative charge. The charge value and the polarity of the toner particles are influenced by means of one or more so-called charge control agents.

In order to fix the toner particles at the places where they are deposited electrostatically, each particle comprises a resin coating, which may also play the role of dispersing agent and may serve also as charge control agent when containing ionic groups.

Charging of the dispersed particles may proceed according to one method by a chemical compound that provides a charge from a chemical dissociation reaction on the toner particle surface and the introduction of a counter-ion in the electrically insulating carrier liquid (ref. *Electrophotography*—A Review by R. B. Comizolli et al., Proc. of the IEEE, Vol. 60. No. 4, April 1972, p. 363).

According to the U.S. Pat. No. 3,788,995 a liquid developer for the development of electrostatic charge patterns is provided which developer contains at least one polymer with at least two monomeric moieties, at least one of said monomeric moieties being a polar moiety and at least one other of said monomeric moieties being a moiety soluble in the carrier liquid, the polar moiety being selected from the group consisting of:

a. sulfoalkyl acrylates;
b. sulfoalkyl methacrylates;
c. metal salts of sulfoalkyl acrylates;
d. metal salts of sulfoalkyl methacrylates;
e. amine salts of sulfoalkyl acrylates;
f. amine salts of sulfoalkyl methacrylates;
g. metal salts of acids selected from the group consisting of acrylic and methacrylic acids; and
h. amine salts of acids selected from the group consisting of acrylic and methacrylic acids; and mixtures thereof.

The toner particles in the developer obtain a positive charge. Explicitely mentioned amine salts are derived from dimethylamine and diethylamine.

According to U.S. Pat. No. 3,977,983 a liquid for use in the development of an electrostatic charge pattern is provided, said liquid developer containing as charge-controlling agent a copolymer having amino groups converted into quaternary ammonium salt groups or quaternary ammonium hydroxide, the anions of said copolymer rendering the toner particles negatively charged.

Examples of counter-anions mentioned in said US-P (-983) are chloride, bromide, iodide, dimethyl sulphate, diethyl sulphate, p-toluene sulphonate and the hydroxyl anion.

It is an object of the present invention to provide an electrophoretic liquid developer containing negatively charged toner particles with particularly stable particle charge in time.

Other objects and advantages of the present invention will be clear from the further description.

According to the present invention a liquid developer composition is provided that is suitable for rendering visible electrostatically charged areas, which composition contains in an electrically insulating non-polar carrier liquid having a volume resistivity of at least $10^9$ ohm.cm and a dielectric constant less than 3, dispersed colouring matter acting as toner particles and at least one anionic polymer that includes recurring units incorporating an anionic group together with a non-polymeric counter cation, characterized in that the cation is a member selected from the group consisting of:

(1) a cationic group being a protonated tertiary amine group,
(2) a quaternary ammonium group, a phosphonium group or a sulphonium group, and
(3) a cationic group containing at least one carbon chain residue comprising at least 6-C atoms, whereby the said polymer is absorbed with a net negative charge on the toner particles.

Counter cations having at least one of said characteristics (1) to (3) have a large effective radius and still sufficient mobility in the carrier liquid. The charge density on the cation is lowered by enlarging the cation radius so that only a weak electric field strength is present at the periphery of the cation whereby the dissociation of the ion pair composed of the anionic groups on the polymer chain and its counter cation increases. An improved affinity (oleophility) of the counter cation for the non-polar carrier liquid allows a better dissociation.

Examples of cations for use according to the present invention having a large radius and a correspondingly low surface charge density ($C/m^2$) correspond to one of the following general formulae:

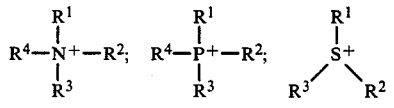

wherein:

(1) each of $R^1$, $R^2$, $R^3$ and $R^4$ (same or different) is a hydrocarbon group including a substituted hydrocarbon group, e.g. an alkyl group or an aralkyl group, e.g. benzyl and the alkyl group has preferably at least 3 C-atoms, or
(2) $R^1$ is hydrogen and $R^2$, $R^3$ and $R^4$ each have the meaning as defined in (1), or (3) $R^1$ and $R^4$ each is hydrogen and each of $R^2$ and $R^3$ is a hydrocarbon group of which at least one contains 6 C atoms, (4) $R^1$, $R^2$ and $R^3$ each is hydrogen and $R^4$ is a hydrocarbon group containing at least 6 C atoms, or (5) $R^2$ and $R^3$ represent together the necessary atoms to close a heterocyclic ring, e.g. pyridine, morpholine, piperidine, piperazine, azepine, tetrahydropyrrole or imidazole ring, and each of $R^1$ and $R^4$ (when present) is a hydrocarbon group, e.g. an alkyl group, or $R^1$ is hydrogen and $R^4$ (when present) is a hydrocarbon group.

The anionic polymers may be homopolymers or copolymers.

The anionic polymers for use according to the present invention may be prepared by addition polymerisation of the monomer(s) with acid groups which groups are allowed to react with an amine to form amino salt groups or they are prepared by allowing to react a polymer having ester groups with a tertiary amine.

When preparing a copolymer containing anionic recurring units, these monomer units may be distributed at random in the copolymer chain with other monomer units, e.g. hydrophobic monomer units. The copolymer may likewise be a block- or graft copolymer containing groups or blocks of said monomer units. The salt production or quaternization has not to proceed quantitatively, which means that residual free acid or ester groups may still be present.

Suitable anionic monomers wherefrom the recurring units of the present anionic polymer are derived are represented by the following general formula:

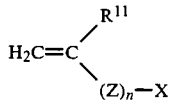

wherein:

$R^{11}$ is hydrogen or lower($C_1$–$C_3$)alkyl, and

Z is a bivalent organic group, e.g. a bivalent hydrocarbon group such as an alkylene group or an arylene group or is a bivalent hydrocarbon group interrupted by one or more hetero-atoms, e.g. nitrogen and/or oxygen or interrupted by a —O—CO— group or is a bivalent —CONH—alkylene group, n is zero or 1, and X is $—COO^-$, $—SO_3^-$, $—SO_4^-$, $—PO_4H_2^-$ or $—PO_4HR^-$, wherein R is hydrocarbon group.

For obtaining a better dispersing character copolymers are used which contain said anionic monomers in conjunction with non-ionic hydrophobic monomers solvatable by the carrier liquid.

Optionally used non-ionic hydrophobic solvatable monomers are listed hereinafter in List I.

List I alkylstyrenes having from 3 to 10 carbon atoms in the alkyl group, alkoxystyrenes having from 3 to 10 carbon atoms in the alkyl group, alkyl acrylates and methacrylates having from 8 to 22 carbon atoms in the alkyl group vinyl alkyl ethers having from 8 to 22 carbon atoms in the alkyl group, vinyl esters of alkanoic acids having from 6 to 22 carbon atoms in the alkyl group.

Preferred non-ionic hydrophobic solvatable monomers are: lauryl acrylate, lauryl methacrylate, hexadecyl methacrylate, octadecyl methacrylate, vinyl laurate, vinyl palmitate, vinyl stearate, vinyl eicosate and vinyl docosate.

The non-ionic hydrophobic solvatable monomer units may be used in admixture with substantially non-solvatable non-ionic monomer units. Examples of such non-ionic non-solvatable monomers are enumerated in List II.

List II (a) $\alpha,\beta$-ethylenically unsaturated carboxylic acid alkyl esters with alkyl $C_1$–$C_4$ group;

(b) styrene, methylstyrene, methoxystyrene and halogenated styrene;

(c) vinyl alkyl ethers having from 1 to about 4 carbon atoms in the alkyl group, and (d) vinyl esters of alkanoic acid having from about 1 to about 4 carbon atoms in the alkyl groups and mixtures thereof.

Examples of non-ionic "non-solvatable" monomers are: styrene, vinyltoluene, ethyl acrylate, propyl methacrylate, isobutyl methacrylate, vinyl acetate, vinyl propionate, vinyl butyrate and mixtures thereof. These monomers make the resulting copolymer harder so that smearing out of the deposited toner image is much more difficult.

In order to illustrate in detail the preparation of polymers containing anionic monomers the following preparations are given.

Preparation I

A. Copolymer Ia having the following structural formula:

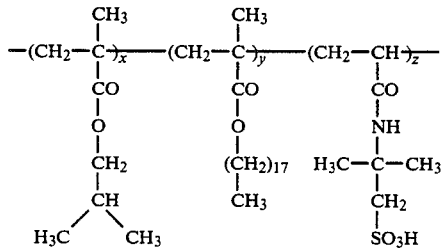

was prepared as follows:

A solution of 21 g of isobutyl methacrylate, 6 g of stearyl methacrylate and 3 g of 2-acrylamido-2-methylpropane sulphonic acid, 60 mg of azo-diisobutyronitrile in 120 ml of dimethylformamide was freed of oxygen of the air by bubbling-through nitrogen for 15 min. The copolymerization was carried out for 24 h at 70° C. keeping the reaction mixture under a constant stream of nitrogen. After cooling to 20° C. the copolymer was separated by precipitation in water. The copolymer was washed thoroughly with water and dried at 20° C. under diminished pressure. The sulphonic acid content was 0.231 milliequivalents/gram (meq/g) which corresponds with z=4.8% by weight.

B. Copolymer Ib having the following structural formula:

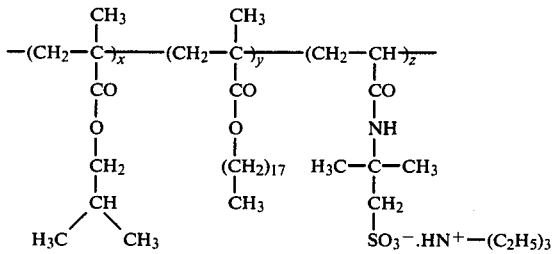

was prepared as follows:

to a solution of 15 g of copolymer Ia in 40 ml of acetone 0.35 g of triethylamine in 10 ml of acetone were added dropwise.

The solution was boiled with reflux for 2 h. After cooling to 20° C. the obtained copolymer was separated by precipitation in water. The copolymer was washed thoroughly with water and dried at 20° C. under diminished pressure.

Yield: 90%.

Preparation II

A. Copolymer IIa having the following structural formula:

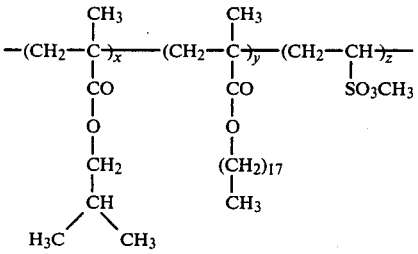

was prepared as follows:

A solution of 17.5 g of isobutyl methacrylate, 5 g of stearyl methacrylate, 2.5 g of vinyl sulphonic acid methyl ester, prepared according to Angew. Chem. 77, 291 (1965), and 50 mg of azo-diisobutyronitrile (ABN) in 100 ml of butanone was freed of oxygen of the air by bubbling-through dry nitrogen gas and in that condition copolymerisation was allowed to take place at 70° C. for 4 days using at each interval of 24 h an additional amount of 50 mg of ABN.

After cooling at 20° C. the obtained copolymer was separated by precipitation in methanol. The product was washed with methanol and dried at 20° C. under diminished pressure. Yield: 80%. Copolymerized vinyl sulphonic acid methylester: 3.6% by weight.

B. Copolymer IIb having the following structural formula:

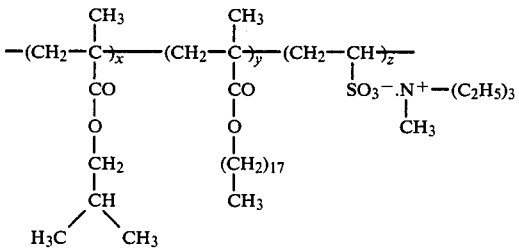

was prepared as follows:

to a solution of 5 g of copolymer IIa in 20 ml of acetone 2.5 g of triethylamine in 5 ml of acetone were added dropwise. The solution was boiled with reflux for 24 h. After cooling to 20° C. the copolymer was separated by precipitation in methanol. The copolymer was washed with methanol and dried at 20° C. under diminished pressure.

Yield: 90%.

Preparation III

Copolymer IIIa being a block-copolymer of the A—B—A type having the following structural formula:

poly[SMA—b—(styrene—co—VBCl)—b—SMA]

wherein:

SMA = stearylmethacrylate, and

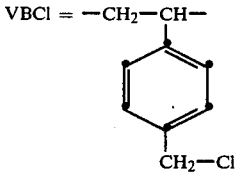

was prepared as follows:

Step 1

In a polymerization tube 38.5 ml of styrene, 3.83 g of vinylbenzyl chloride and 4 g of 4,4'-azo-bis(4-cyanovaleric acid) (ACVZ) in 200 ml of dioxane were introduced under a protective cover of dry nitrogen gas. The mixture was heated with reflux for 16 h at 80° C. Thereupon the reaction mixture was poured into cold methanol wherein the copolymer of styrene and vinylbenzyl chloride precipitated. Purification proceeded by re-dissolving in dioxane and re-precipitating in methanol. The copolymer contained 8 mol % of vinylbenzyl chloride units and ended in two terminal carboxyl groups stemming from the ACVZ.

Step 2

To 1 g of terminally carboxylated PST-VBCl copolymer, 50 ml of freshly distilled thionyl chloride was added in dry conditions and kept boiling with reflux for 12 h. Thereupon the reaction mixture was evaporated to dry in a rotary evaporator using benzene to remove any residual traces of thionyl chloride.

To the obtained copolymer having terminal acid chloride groups an equivalent amount of polystearyl methacrylate having one terminal HO-group (PSMA—OH) was added in a mixture of 45 ml of benzene and 0.5 ml of pyridine.

The PSMA-OH polymer prepared as described in U.S. Pat. No. 4,522,908 was dried in a Dean and Stark apparatus before use.

The reaction mixture was allowed to boil with reflux for 3 days, whereupon the block-copolymer was precipitated in methanol. The precipitate was separated, dissolved again and treated with n-hexane whereby the non-reacted PST-VBCl was precipitated and removed by centrifuging. From the clear solution the block-copolymer IIIa was separated by removing the solvent.

Step 3

The block-copolymer IIIa was allowed to react for 4 days at 80° C. with an excess of $Bu_4N^+.^-OOC—(CH_2$-

$)_2—COO^-.N^+Bu_4$ in a mixture of chlorobenzene and water (80/50 by volume) analogously to the method described by Flechet in J. Org. Chem. 44, 1774 (1979). Hereby the copolymer IIIb having recurring units with the following structure:

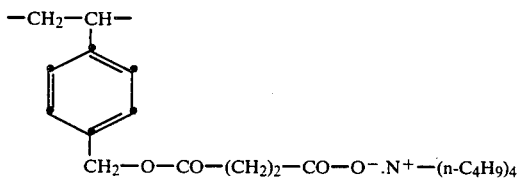

was obtained.

Preparation IV

A. Copolymer IVa having the following structural formula:

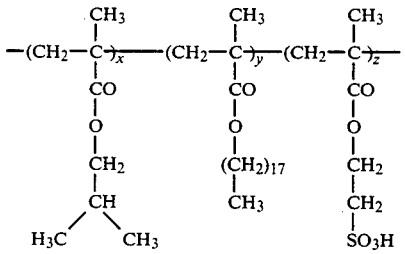

x=70 weight %
y=20 weight %
z=10 weight %
was prepared as follows:

A solution of 35 g of isobutyl methacrylate, 10 g of stearyl methacrylate and 5 g of sulphoethyl methacrylate and 250 mg of azo-diisobutyronitrile in 100 ml of dioxane was freed of oxygen of the air by bubbling-through nitrogen. The copolymerization was carried out for 24 h at 70° C. keeping the reaction mixture under a constant stream of nitrogen. After cooling to 20° C. the copolymer was separated by precipitation in water and dried at 20° C. under diminished pressure.

Yield: 46.5 g. The sulphonic acid content was 0.591 meq/g.

B. Copolymer IVb having the following structural formula:

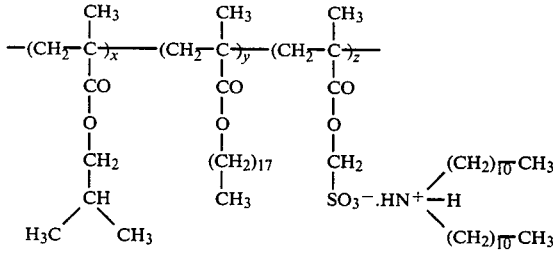

x=70 weight %
y=20 weight %
z=10 weight %
was prepared as follows:

A solution of 20 g of copolymer IVa and 3.66 g of dilaurylamine in 100 ml of acetone was stirred for 24 h at 20° C. Thereupon the reaction mixture was boiled with reflux and the copolymer separated by precipitation in water.

The copolymer was washed thoroughly with methanol and dried under diminished pressure.

Yield: 22 g.

A particularly useful group of anionic copolymers for the preparation of liquid toner developers of the invention contains from 10 to 88.5 percent by weight of non-ionic solvatizable monomer units, from 10 to 80 percent by weight of non-solvatizable monomer units and from 1.5 to 50 percent by weight of anionic monomer units in association with one of the defined cations. The percent by weight of anionic polymer with respect to the colouring matter (e.g. carbon black) of the liquid developer is preferably in the range of 2 to 50.

For a still better dispersing capability of the toner particles the homopolymer or copolymer containing said anionic recurring groups may be used in conjunction with non-ionic copolymers of the type disclosed in GB Pat. No. 1,572,343 and block-copolymers disclosed in U.S. Pat. No. 4,522,908.

The insulating liquid used as carrier liquid in the present liquid developer may be any kind of non-polar, fat-dissolving solvent. Said liquid is preferably a hydrocarbon solvent e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons having a boiling range preferably between 150° C. and 220° C. such as the ISOPARS G, H, K and L (trade marks) of Exxon and SHELLSOL T (trade mark) of the Shell Oil Company.

The colouring substance used in the toner particles may be any inorganic pigment (said term including carbon black) or solid organic dyestuff pigment commonly employed in liquid electrostatic toner compositions. Thus, for example, use can be made of carbon black and analogous forms thereof e.g. lamp black, channel black and furnace black e.g. RUSS PRINTEX 140 GEPERLT (trade-name of DEGUSSA—Frankfurt/M, W.Germany).

Typical solid organic dyestuffs are so-called pigment dyes, which include phthalocyanine dyes, e.g. copper phthalocyanines, metal-free phthalocyanine, azo dyes and metal complexes of azo dyes.

The following dyes in pigment form are given for illustration purposes only: FANALROSA B Supra Pulver (trade-name of Badische Anilin- & Soda-Fabrik AG, Ludwigshafen, Western Germany), HELIOGENBLAU LG (trade-name of BASF for a metal-free phthalocyanine blue pigment), MONASTRAL BLUE (a copper phthalocyanine pigment, C.I. 74,160). HELIOGENBLAU B Pulver (trade-name of BASF), HELIOECHTBLAU HG (trade-name of Bayer AG, Leverkusen, Western Germany, for a copper phthalocyanine C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Patent Specification Nos. 1,394,061 filed Dec. 23, 1963 by Kodak Co., and 1,439,323 filed Apr. 24, 1965 by Harris Int.Corp.

Preferred carbon black pigments are marketed by DEGUSSA under the trade name PRINTEX. PRINTEX 140 and PRINTEX G are preferably used in the developer composition of the present invention. The characteristics of said carbon blacks are listed in the following Table 2.

TABLE 2

| | PRINTEX 140 | PRINTEX G |
|---|---|---|
| origin | channel black | furnace black |
| density | 1.8 g · cm$^{-3}$ | 1.8 g · cm$^{-3}$ |
| grain size before entering the developer | 29 nm | 51 nm |
| oil number (g of linseed oil adsorbed by 100 g of pigment) | 360 | 250 |
| specific surface (sq.m per g) | 96 | 31 |
| volatile material % by weight | 6 | 2 |
| pH | 5 | 8 |
| colour | brown-black | blue-black |

As colour corrector for the PRINTEX pigments preferably minor amounts of copper phthalocyanine are used, e.g. from 1 to 20 parts by weight with respect to the carbon black.

For a given charge density of the charge-carrying surface the maximum development density attainable with toner particles of a given size is determined by the charge/toner particle mass ratio, which is determined substantially by the amount and/or type of anionic polymer employed.

A liquid developer composition according to the present invention can be prepared by using dispersing and mixing techniques well known in the art. It is conventional to prepare by means of suitable mixers e.g. a 3-roll mill, ball mill, colloid mills, high speed stirrers, a concentrate of e.g. 5 to 80% by weight of the solid materials selected for the composition in the insulating carrier liquid and subsequently to add further insulating carrier liquid to provide the liquid toner composition ready for use in the electrostatic reproduction process. It is generally suitable for a ready-for-use electrophoretic liquid developer to incorporate the toner in an amount between 0.3 g and 20 g per liter, preferably between 2 g and 10 g per liter.

The polymer(s) used in the present developer liquid can be applied as a pre-coating to the pigment particles prior to their introduction in the carrier liquid or can be introduced as a separate ingredient in the liquid and allowed to become adsorbed onto the pigment particles.

The electrophoretic development may be carried out using any known electrophoretic development technique or device. The field of the image to be developed may be influenced by the use of a development electrode. The use of a development electrode is of particular value in the development of continuous tone images and in reversal development. Reversal development proceeds with toner deposition in the light-exposed area of the photoconductive recording element that before the image-wise exposure had been charged overall. In reversal development a development electrode is normally used.

The following examples illustrate the present invention.

EXAMPLE 1

1 g of copolymer Ib prepared according to preparation I was first dissolved in 50 ml of butanone and 4 g of PRINTEX G (trade name) carbon black pigment was dispersed therein.

After dispersion the solvent was evaporated leaving the copolymer coated onto the carbon black particles.

The copolymer-coated carbon black was then redispersed in 50 ml of isododecane by ball-milling for 15 h.

The charge sign of the toner particles and their charge stability were determined by a test proceeding as follows:

"In an electrophoresis cell having two planar electrodes each with a surface of 20 cm$^2$ spaced at a distance of 0.15 cm is filled with the above toner developer of which 4 ml were diluted with 1 liter of isododecane. The electric current (I) flowing between the two electrodes at a voltage pulse of 500 V for 0.5 s is measured."

The current (I) is the result of a charge (Q) transport due to the inherent conductivity of the liquid without toner and the electrophoretic toner particle displacement towards one of the electrodes. The toner-deposition (blackening) of the positive electrode (anode) proves that the toner particles are negatively charged. The $Q_T$ value is the current I in ampères integrated over the period (t) of 0.5 s and is a measure for the charge on the toner particles.

The charge stability of the toner particles was determined by measuring the $Q_{T1}$ value immediately after the developer preparation and $Q_{T2}$ 1 week thereafter upon redispersing optionally precipitated toner by stirring. A small difference in $Q_T$ value points to a high charge stability per toner particle i.e. a poor ion association and low particle agglomeration.

In the present example $Q_{T1}$: $-5.10^{-8}$C and $Q_{T2}$: $-5.10^{-8}$C.

The average diameter of the toner particles was about 260 nm measured with the COULTER (trade mark) NANO-SIZER. The measuring principles used in this instrument are those of Brownian motion and autocorrelation spectroscopy of scattered laser light. The frequency of this Brownian motion is inversely related to particle size.

EXAMPLE 2

1 g of copolymer IIb prepared according to preparation II was dissolved in 50 ml of isododecane and was milled in a ball-mill for 15 h together with 4 g of PRINTEX G (trade name) carbon black. The obtained dispersion contained toner particles with an average grain size 275 nm measured as described in Example 1. The $Q_{T1}$ value as defined in Example 1 was $-3.10^{-8}$C and the $Q_{T2}$ value: $-3.10^{-8}$C.

EXAMPLE 3

1 g of block-copolymer IIIb prepared according to preparation III was dissolved in 50 ml of isododecane and was milled in a ball-mill for 15 h together wit 4 g of PRINTEX G (trade name) carbon black.

The obtained dispersion contained toner particles with a negative charge sign and average grain size of 200 nm measured as described in Example 1.

The $Q_{T1}$ value as defined in Example 1 was $-4.10^{-8}$C and the $Q_{T2}$ value was $-5.10^{-8}$C.

The toner dispersion was used in reversal-development, more particularly for developing the image-wise light-exposed area of a previously overall negatively charged photoconductive recording layer containing photoconductive zinc oxide in an electricallly insulating binder.

EXAMPLE 4

1 g of copolymer IVb prepared according to preparation IV was first dissolved in 50 ml of acetone and 4 g of PRINTEX G (trade name) carbon black pigment was dispersed therein.

After dispersion the solvent was evaporated leaving the copolymer coated onto the carbon black particles.

The copolymer-coated carbon black was the redispersed in 50 ml of isododecane by ball-milling for 15 h.

The obtained dispersion contained toner particles with a negative charge sign and average grain size of 500 nm measured as described in Example 1.

The $Q_{T1}$ value as defined in Example 1 was $-3.10^{-8}$C and the $Q_{T2}$ value was $-3.10^{-8}$C.

The toner dispersion was used in reversal-development, more particlularly for developing the image-wise light-exposed area of a previously overall negatively charged photoconductive recording layer containing photoconductive zinc oxide in an electrically insulating binder.

For improving the dispersing of the carbon black pigment in the preparation of the toner developers of the Examples 1-2 and 4 block-copolymer No. 10 of Table 4 of U.S. Pat. No. 4,522,908 in a 10% by weight ratio with respect to the pigment was used.

We claim:

1. A liquid developer composition that is suitable for rendering visible electrostatically charged areas which composition contains in an electrically insulating non-polar carrier liquid having a volume resistivity of at least $10^9$ ohm.cm and a dielectric constant less than 3, dispersed colouring matter acting as toner particles and at least one anionic polymer that includes recurring units incorporating an anionic group together with a non-polymeric counter cation, characterized in that said cation is a member selected from the group consisting of:

(1) a cationic group being a protonated tertiary amine group, (2) a quaternary ammonium group, a phosphonium group or a sulphonium group, and (3) a cationic group containing at least one carbon chain residue comprising at least 6 C-atoms, whereby the said polymer is adsorbed with a net negative charge on the toner particles.

2. Liquid developer composition according to claim 1, wherein said cation selected from the group consisting of one of the following general formulae:

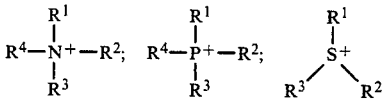

wherein:

(1) each of $R^1$, $R^2$, $R^3$ and $R^4$ (same or different) is a hydrocarbon group, or (2) $R^1$ is hydrogen and $R^2$, $R^3$ and $R^4$ each have the meaning as defined in (1), or (3) $R^1$ and $R^4$ each is hydrogen and each of $R^2$ and $R^3$ is a hydrocarbon group of which at least one contains 6 C atoms, or (4) $R^1$, $R^2$ and $R^3$ each is hydrogen and $R^4$ is a hydrocarbon group containing at least 6 C atoms, or (5) $R^2$ and $R^3$ represent together the necessary atoms to close a heterocyclic ring and each of $R^1$ and $R^4$ (when present) is a hydrocarbon group or $R^1$ is hydrogen and $R^4$ (when present) is a hydrocarbon group.

3. Liquid developer composition according to claim 1, wherein anionic monomers wherefrom the anionic recurring units of said anionic polymer are derived correspond to the following general formula:

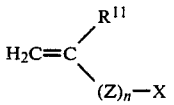

wherein:

$R^{11}$ is hydrogen or lower($C_1$-$C_3$)alkyl, and

Z is a bivalent hydrocarbon group or a bivalent hydrocarbon group interrupted by one or more hetero-atoms or interrupted by a —O—CO— group or is a bivalent —CONH—alkylene— group, n represents zero or 1, and X is $—COO^-$, $—SO_3^-$, $—SO_4^-$, $—PO_4H_2^-$ or $—PO_4HR^-$, wherein R is a hydrocarbon group.

4. Liquid developer composition according to claim 1, wherein the anionic polymer is a copolymer including monomer units solvatable by the carrier liquid.

5. Liquid developer composition according to claim 4, wherein said solvatable monomer is selected from the group consisting of:

alkylstyrenes having from 3 to 10 carbon atoms in the alkyl group, alkoxystyrenes having from 3 to 10 carbon atoms in the alkyl group, alkyl acrylates and methacrylates having from 8 to 22 carbon atoms in the alkyl group vinyl alkyl ethers having from 8 to 22 carbon atoms in the alkyl group, vinyl esters of alkanoic acids having from 6 to 22 carbon atoms in the alkyl group.

6. Liquid developer composition according to claim 4, wherein said copolymer also includes recurring units of non-ionic monomers that are substantially non-solvatable by the carrier liquid and are selected from the group consisting of:

(a) $\alpha,\beta$-ethylenically unsaturated carboxylic acid alkyl esters with alkyl $C_1$-$C_4$ group;

(b) styrene, methylstyrene, methoxystyrene and halogenated styrene;

(c) vinyl alkyl ethers having from 1 to about 4 carbon atoms in the alkyl group, and (d) vinyl esters of alkanoic acids having from 1 to 4 carbon atoms in the alkyl groups and mixtures thereof.

7. Liquid developer composition according to claim 1, wherein the colouring matter is carbon black.

8. Liquid developer composition according to claim 1, wherein the anionic polymer is present with respect to the colouring matter in a percent by weight in the range of 2 to 50.

* * * * *